US006276256B1

(12) United States Patent
Kimmig

(10) Patent No.: US 6,276,256 B1
(45) Date of Patent: Aug. 21, 2001

(54) BREECHBLOCK FOR BARREL WEAPONS

(75) Inventor: Clemens Kimmig, Oppenau (DE)

(73) Assignee: Sommer + Ockenfus GmbH, Beiersbronn (DE)

( * ) Notice: Subject to any disclaimer, the term of this patent is extended or adjusted under 35 U.S.C. 154(b) by 0 days.

(21) Appl. No.: 09/374,898

(22) Filed: Aug. 13, 1999

(30) Foreign Application Priority Data

Aug. 14, 1998 (DE) ..... 198 36 964

(51) Int. Cl.[7] ..... F41A 3/46

(52) U.S. Cl. ..... 89/187.02; 89/187.01; 89/186

(58) Field of Search ..... 89/187.02, 173, 89/174, 187.01; 42/16

(56) References Cited

U.S. PATENT DOCUMENTS 2,267,501 * 12/1941 Holek .
2,649,800 * 8/1953 Peters ..... 42/16
3,044,203 * 7/1962 Wilhelm et al. .
3,191,331 * 6/1965 Hurley .
3,969,983 * 7/1976 Zellweger et al. .
4,161,836 * 7/1979 Hayashi .
4,213,621 * 7/1980 Claypool .
4,461,203 * 7/1984 Jawdat .
4,655,118 * 4/1987 Bruderer et al. .
4,909,129 * 3/1990 Reynolds .
5,913,262 * 6/1999 Keppeler .
6,101,919 * 8/2000 Murello .

FOREIGN PATENT DOCUMENTS 197 34 042 A1 8/1997 (DE) ..... F41A/3/34
880 598 4/1943 (FR) .

* cited by examiner

*Primary Examiner*—Charles T. Jordan
*Assistant Examiner*—Troy L. Chambers
(74) *Attorney, Agent, or Firm*—Darby & Darby

(57) ABSTRACT

Breechblock for barrel weapons, having a breechblock head which is guided in a breechblock guide and, by means of a control element which can be moved to and fro in a straight line and has control ramps, can be brought out of a loading position into a locking position, which is parallel to and axially displaced with respect to the loading position, inside a breechblock bearing, which breechblock head has supporting surfaces, which are associated in a form-locking manner with the control ramps of the control element, and at least one locking boss, which corresponds with a recess in the breechblock, for the purpose of locking in the locking position.

8 Claims, 3 Drawing Sheets

BREECHBLOCK FOR BARREL WEAPONS

BACKGROUND OF THE INVENTION

The invention relates to a breechblock for barrel weapons, having a breechblock head which is guided in a breechblock guide and, by means of a control element which can be moved to and fro in a straight line and has control ramps, can be brought out of a loading position into a locking position, which is parallel to and axially displaced with respect to the loading position, inside a breechblock bearing, which breechblock head has supporting surfaces, which are associated in a form-locking manner with the control ramps of the control element, and at least one locking boss, which corresponds with a recess in the breechblock, for the purpose of locking in the locking position, as represented in U.S. Pat. No. 3,044,203 A, for example.

The breechblock head is there surrounded by a slide, which is held by way of guide lugs and a bolt carriage, the extensions of which are led in a straight line by way of slits in the side walls of the bolt housing. In order to be able axially to lift the breechblock head during the rectilinear movement which is initiated by way of a stem, there are provided in the breechblock head inclined grooves, with which corresponding projections of the stem cooperate. Furthermore, the breechblock head has a locking boss with an inclined surface, which locking boss can engage in a recess in the bolt housing when the breechblock head takes up the locking position.

Such a bolt is constructed so as to be relatively long and in addition to a breechblock head of complicated construction requires a slide which is likewise of complicated construction and a bolt carriage, all of which are to be guided in the bolt housing.

A further disadvantage of this breechblock is to be seen in that because of the locking surface which is only on the upper side, it makes it difficult to transfer the overturning moment, which occurs during the development of the shot, via the slide to the bolt carriage, something which requires the components to have a fit with close tolerances.

According to a subsequently published proposal, the breechblock head of such a breechblock with recesses in the breechblock bearing has corresponding locking bosses and is provided with control pins which cooperate with control ramps of a control plate which can be moved in a straight line, in order to be able to bring the breechblock head out of the loading position into the locking position; see DE 197 34 042 A1.

Many other breechblocks which render possible the loading and sealing closure of the rear barrel end after the barrel weapon has been loaded are also known. The most usual are, in the case of hand firearms, so-called rotating boss breechblocks, in which by means of a manual downwards movement, at right angles to the weapon axis, of a bolt handle, a locking boss is rotated into a recess of the barrel or the breech casing for locking; see U.S. Pat. No. 2,649,800 A.

SUMMARY OF THE INVENTION

The underlying object of the invention is now to provide a breechblock for barrel weapons, in particular those having a so-called straight-pull breechblock, the construction of which for the movement out of the loading position into the locking position and vice versa is designed more simply than before.

Starting from the breechblock mentioned in the introduction, this object is achieved in accordance with the invention as a result of the fact that the control ramps are parts of arcuate control slits of guide rails, which are arranged on both sides of the breechblock head and with which there are associated as supporting surfaces control pegs connected to the breechblock head, and that provided on the breechblock head are locking bosses corresponding to recesses in the breechblock bearing, all of these in such an arrangement that when the guide rails are moved, the breechblock head can, by way of its control pegs, in the extent of the guide embodied by the control ramps of the control slits, be brought in a form-locking manner out of the loading position into the locking position, which is at a distance and axially displaced, and be locked there.

The development in accordance with the invention of the breechblock achieves a central take-up of the gas pressure which occurs when the shot is fired, because there is provided on the breechblock head a plurality of locking bosses, which are locally and axially displaced with respect to each other and which are engaged with the corresponding recesses in the breechblock bearing and therefore prevent any tilting of the breechblock head. In this way, an optimal shot precision is rendered possible with technically simple means.

According to a further feature of the invention, all of the locking bosses and the recesses which cooperate therewith have surfaces which each have run-down slopes at the same angle, by which, in the case of the backward movement of the breechblock head over the control ramps, there is generated a power ratio which renders possible with the most minimal expenditure of force an opening of the breechblock after the shot has been fired.

Further features of the invention emerge from the subclaims.

BRIEF DESCRIPTION OF THE DRAWINGS

In the following, the invention is explained in greater detail with the aid of an exemplary embodiment which is represented more or less diagrammatically in the drawing, in which.

DETAILED DESCRIPTION OF THE PRESENTLY PREFERRED EMBODIMENTS

Figure 1:
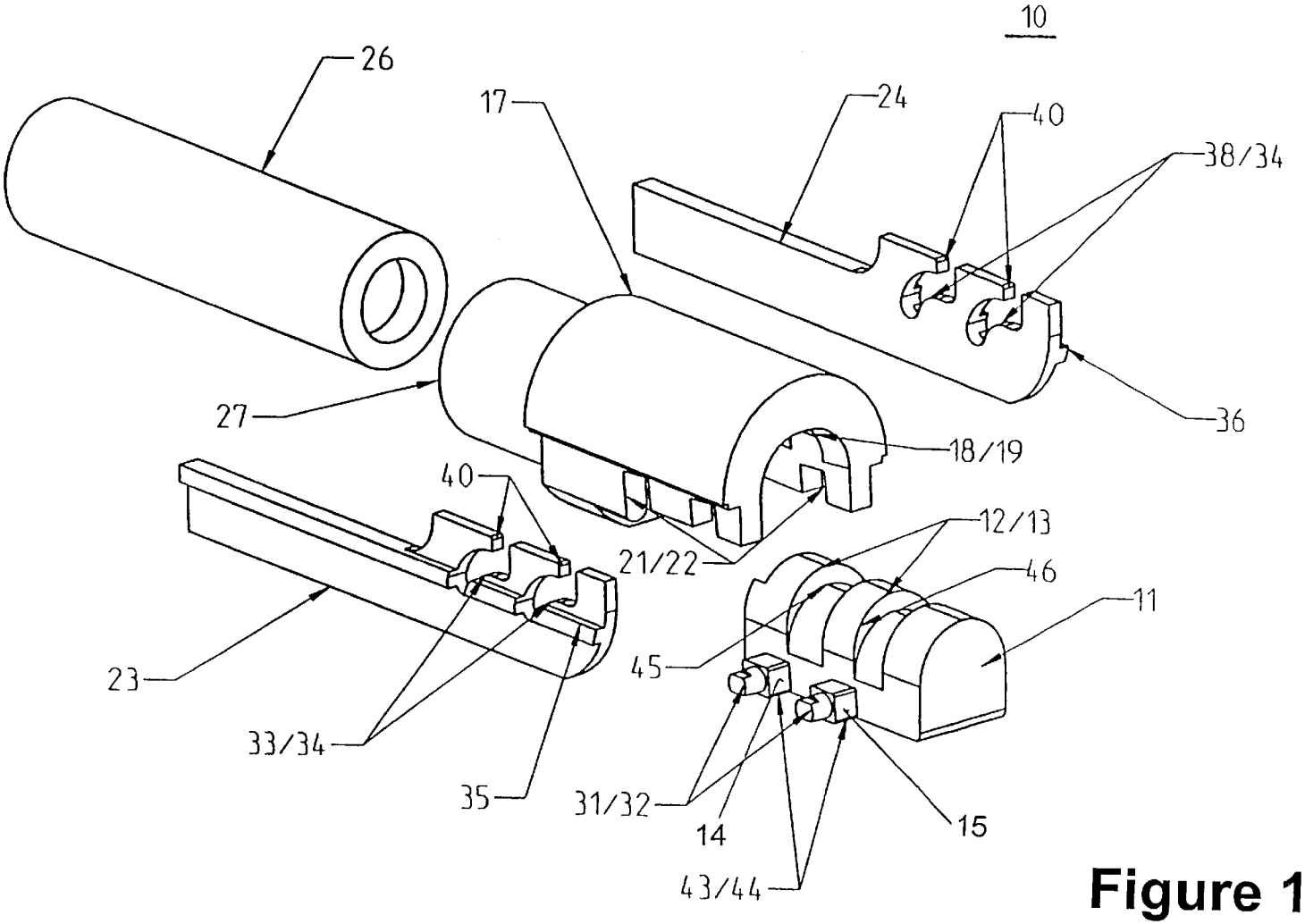
FIG. 1 shows an exploded representation of breechblock bearing, breechblock head and breechblock guide.

A breechblock, which is designated altogether with the reference numeral 10, of a hand firearm (not shown in detail) comprises, as FIG. 1 shows in particular, a breechblook head 11 having upper locking bosses 12 and 13, which are arranged at an axial distance from each other, and lower locking bosses 14 and 15, which are axially displaced with respect thereto, a breechblock bearing 17 having upper recesses 18 and 19, which are arranged at an axial distance from each other, and lower recesses 21 and 22, which are axially displaced with respect thereto, and also guide rails 23 and 24, which are arranged parallel to each other on either side of the breechblock head 11. Furthermore, FIG. 1 shows a barrel 26, which is securely connected to a barrel casing 27 of the breechblock bearing 17, for example by means of a glued joint.

Figure 2:
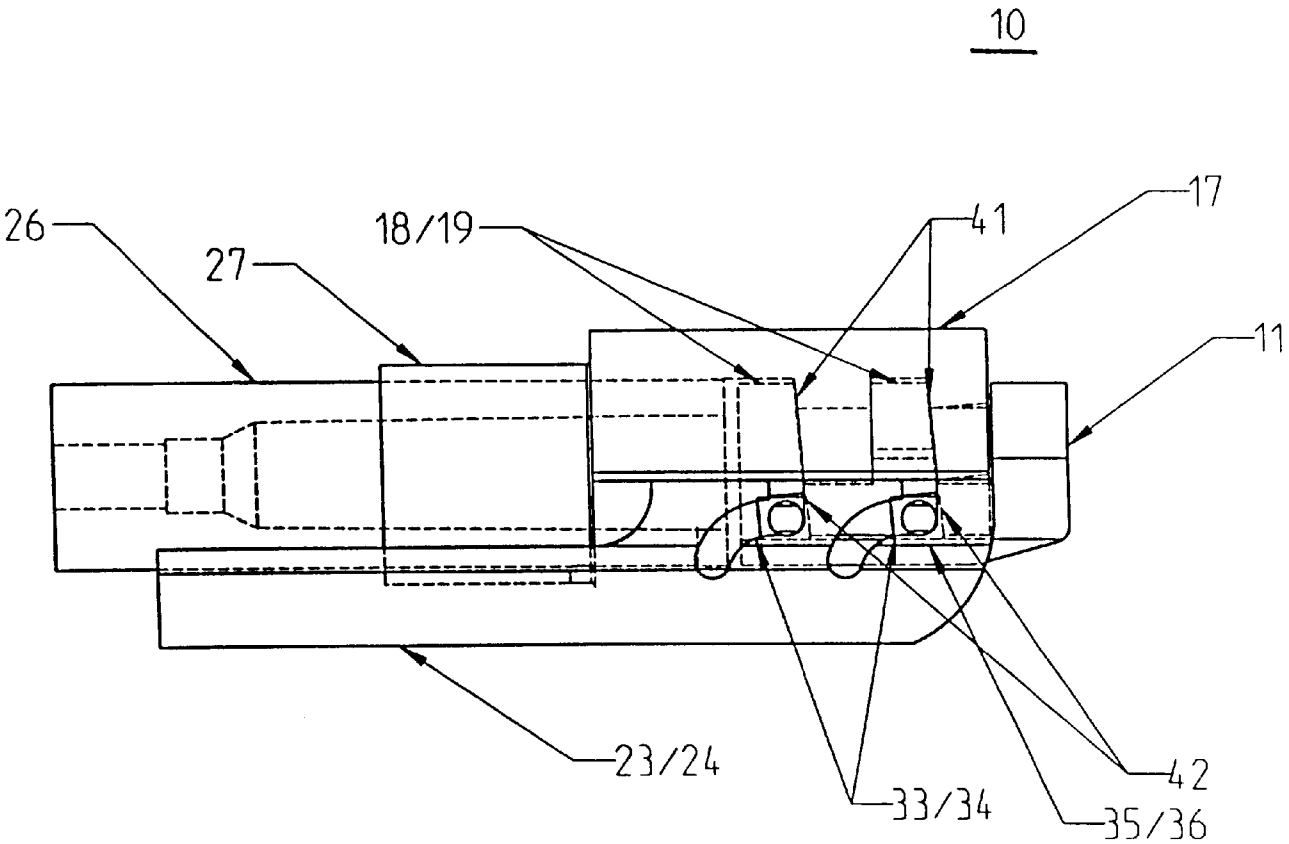
FIG. 2 shows a side view of the breechblock in accordance with FIG. 1, in the locked state.
Figure 3:
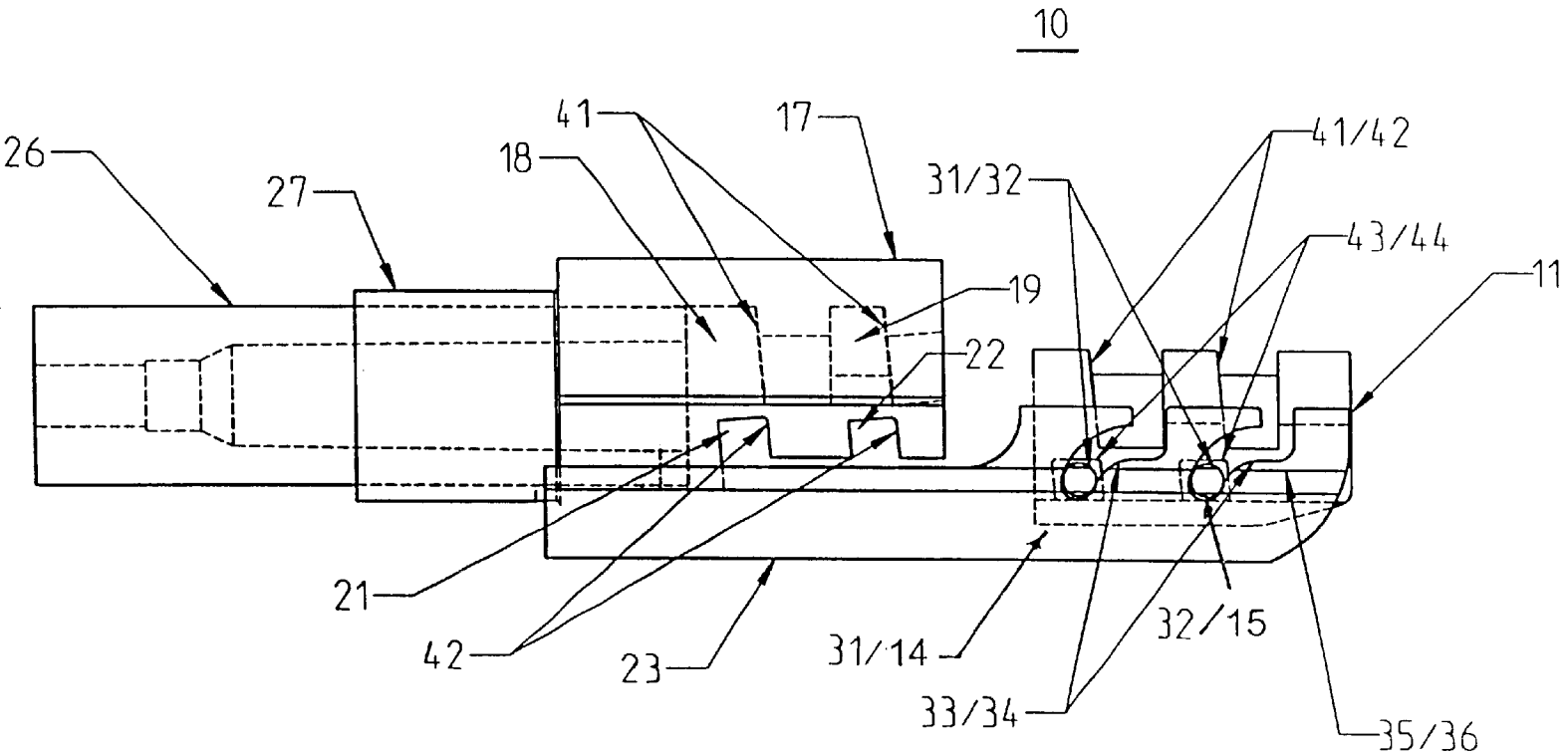
FIG. 3 shows a side view of the breechblock in accordance with FIG. 1, in the unlocked and drawn-back state.

Although FIGS. 1 to 3 show in each case only one side of the breechblock head 11, the opposite side of the breechblock head 11 also carries locking bosses, which are arranged on the same axis as the locking bosses which are shown. All of the lower locking bosses 14 and 15 of the breechblock head 11 turn into control pegs 31 and 32, which can cooperate with arcuate control slits 33 and 34 in the guide rails 23 and 24, see also FIG. 2. The guide rails 23 and 24 have outward-facing guide ledges 35 and 36 which engage in corresponding recesses in the weapon frame (not shown) and are mounted there in a longitudinally displaceable manner. For the purpose of a simple assembly, the arcuate control slits 33 and 34 are provided with a respective opening 40, through which the control pegs 31 and 32 of the breechblock head 11 can be inserted. A stem (not shown) is used to move the guide rails 23 and 24 if the breechblock 10 is to be actuated by hand. It is, however, also possible for the movements of the guide rails 23 and 24 to be carried out in a manner controlled by gas pressure.

As these parts do not belong to the invention, they are neither shown here nor described in greater detail.

As can be seen in particular from FIG. 3, the active surfaces 41 and 42 of the upper and lower recesses 18, 19 and 21, 22, and the active surfaces 43 and 44 and the surfaces 46 and 46 of the upper locking bosses 12 and 13 and of the lower locking bosses 14 and 15, respectively, are inclined at an angle $\alpha$ of preferably 5° with respect to a plane which intersects the bore of the barrel 26 at right angles. These facing surfaces of the recesses and locking bosses therefore have run-down slopes which are inclined by the same angle $\alpha$ so that, in a manner yet to be described, when the guide rails 23 and 24 are moved back, in connection with the transfer of movement to the breechblock head 11 as a result of the control pegs 31 and 32 cooperating with the control slits 33 and 34, there takes place a power ratio which substantially facilitates the unlocking of the breechblock head 11 of the breechblock 10 after the shot has been fired.

The cooperation of the components described is shown in FIGS. 2 and 3, with FIG. 2 showing the locking position and FIG. 3 showing the loading position of the hand firearm.

As mentioned above, in the assembled state, the control pegs 31 and 32 engage in a form-locking manner in the arcuate control slits 33 and 34 of the guide rails 23 and 24. In the case of a simultaneous, synchronous movement of the guide rails 23 and 24 to the left with respect to FIG. 3 into the position shown in FIG. 2, the breechblock head 11 is shifted in the barrel direction into the locking position shown in FIG. 2 and at the same time, in the extent of the ranges of movement specified by the control slits 33 and 34 which embody the control ramps, has its axis lifted and thus is brought in a form-locking manner into the locking position defined by the locking bosses and recesses in the breechblock head 11 and breechblock bearing 17. When the guide rails 23 and 24 are moved to the right with respect to FIG. 2 into the loading position shown in FIG. 3 on the other hand, the breechblock 10 is unlocked in a reversal of the movements described above, this unlocking of the breechblock 10 being facilitated substantially as a result of the surfaces 41, 42, 43, 44, 45 and 46 of locking bosses and recesses in the breechblock bearing 17 and in the breechblock head 11, which surfaces are inclined and act as run-down slopes.

As is evident from the above, the breechblock 10 is moved without rotations or expanding movements of the breechblock head 11, out of the loading position into the locking position and vice versa. Such a breechblock 10 can be used equally well in both long barrel weapons and short barrel weapons. Moreover, it is also to be used in an equally advantageous way in machine cannons and guns.

What is claimed is:

1. A breechblock (10) for a barrel weapon, comprising a breech block bearing (17) designed to accept a barrel (26), the breech block bearing having a bore on one end and being movable engage with a breechblock head (11) and a pair of guide rails (23, 24) on the other end;

the pair of guide rails being disposed on either side of the breechblock head for providing movement from the sides of the breech block head (11) inside the breech block bearing (17) from a loading position into a locking position along a straight line, the locking position being parallel to and axially displaced with respect to the loading position inside the a breechblock bearing (17);

the breechblock head (11) includes control pegs (31,32) associated in a form-locking manner with arcuate control slits (33,34) disposed in the pair of guide rails, and locking bosses (12, 13, 14, 15) corresponding to recesses (18, 19, 21, 22) in the breechblock bearing (17); the recesses (18, 19, 21, 22) having surfaces (41, 42) and wherein the locking bosses having surfaces (43, 44, 45, 46) and wherein the surfaces of the recesses (18, 19, 21, 22) are inclined each at an angle ($\alpha$) with respect to a plane which intersects the bore of the barrel at right angles, which angle facilitates the movement of the breechblock head into the loading position.

2. The breechblock according to claim 1, wherein the locking bosses (12, 13, 14, 15) comprise upper locking bosses (12, 13) and lower locking bosses (14, 15), the upper locking bosses (12, 13) correspond to upper recesses (18, 19) and the lower locking bosses (14, 15) correspond to lower recesses (21, 22) and the upper recesses (18, 19) and the lower recesses (21, 22) are arranged at an axial distance with respect to each other and axially displaced with respect to each other;

wherein the control pegs (31, 32) are arranged on the lower locking bosses (14, 15);

the the control pegs (31,32) of the breech block head (11) engage in the control slits (33, 34) of the guide rails 23).

3. The breechblock according to claim 2, wherein the lower locking bosses (14, 15) and the control pegs (31, 32) are constructed in one piece and in a manner such that they are axially contiguous.

4. The breechblock according to claim 3, wherein the pair of guide rails (23, 24) each comprises a lateral guide ledge, mounted longitudinally on each guide rail.

5. A breechblock for a barrel weapon, having a breechblock head which is guided in a breechblock guide and, by means of a control element which can be moved to and fro in a straight line and has control ramps, can be brought out of a loading position into a locking position, which is parallel to and axially displaced with respect to the loading position, inside a breechblock bearing, which breechblock head has supporting surfaces, which are associated in a formlocking manner with the control ramps of the control element, and at least one locking boss, which corresponds with a recess in the breechblock, for the purpose of locking in the locking position, wherein the control ramps are parts of arcuate control slits (33, 34) of substantially flat guide rails (23, 24) which are arranged on both sides of the breechblock head (11) and with which there are associated as supporting surfaces control pegs (31, 32) connected to the breechblock head (11), and wherein there are provided on the breechblock head (11) locking bosses (12, 13, 14, 15) corresponding to recesses (18, 19, 21, 22) in the breechblock bearing (17), all of these in such an arrangement that when the guide rails (23, 24) are moved, the breechblock head (11) can, by way of its control pegs (31, 32), in the extent of the guide embodied by the control ramps of the control slits (33, 34), be brought in a form-locking manner out of the loading position into the locking position, which is at a distance and axially displaced, and be locked there; the facing surfaces (41, 42, 43, 44, 45, 46) of locking bosses (12 to 15) of the 35 breechblock head (11) and of recesses (18, 19, 21, 22) of the breechblock bearing (17) are inclined at an angle ($\alpha$) with respect to a plane which intersects the bore of the barrel (26) at right angles, which angle facilitates the movement of the breechblock head into the loading position.

6. The breechblock according to claim 5, wherein there are provided at least two groups of locking bosses (12, 13, 14, 15) and recesses (18, 4, 21, 22) arranged at an axial distance with respect to each other and axially displaced with respect to each other, each of which groups is associated with a pair of control pegs (5, 31, 32) on the same axis, which control pegs engage in control slits (33, 34) of the guide rails (23, 24).

7. The breechblock according to claim 6, wherein the lower locking bosses (14, 15) associated with the breechblock head (11) and the associated control pegs (31, 32) are constructed in one piece and in a manner such that they are axially contiguous.

8. The breechblock according to claim 7, wherein the guide rails (23, 24) have lateral guide ledges (35, 36), by means of which they are mounted in a longitudinally displaceable manner in corresponding recesses of a weapon frame of the barrel weapon.

* * * * *